United States Patent [19]

Wolf et al.

[11] Patent Number: 4,930,217

[45] Date of Patent: Jun. 5, 1990

[54] ELECTRIC SHAVING APPARATUS WITH A SHAVING HEAD CONTROL MEANS

[75] Inventors: Jürgen Wolf, Kriftel; Albrecht Jestädt, Friedrichsdorf; Hans E. Heintke, Wächtersbach; Michael Odemer, Frankfurt, all of Fed. Rep. of Germany

[73] Assignee: Braun Aktiengesellschaft, Kronberg, Fed. Rep. of Germany

[21] Appl. No.: 223,554

[22] Filed: Jul. 22, 1988

[30] Foreign Application Priority Data

Aug. 7, 1987 [DE] Fed. Rep. of Germany ..... 3726354

[51] Int. Cl.[5] ..... B26B 19/10

[52] U.S. Cl. ..... 30/43.92; 30/34.1; 30/43.1; 30/89

[58] Field of Search ..... 30/34.1, 43.1, 43.92, 30/89

[56] References Cited

U.S. PATENT DOCUMENTS

| | | | |
|---|---|---|---|
| 3,160,718 | 12/1964 | Andis | 30/43.1 |
| 3,797,109 | 3/1974 | Yamada et al. | 30/89 X |
| 4,505,036 | 3/1985 | Ochiai et al. | 30/34.1 |
| 4,688,329 | 8/1987 | Oord | 30/89 X |
| 4,796,359 | 1/1989 | Oprach et al. | 30/43.92 |

FOREIGN PATENT DOCUMENTS

| | | |
|---|---|---|
| 3610736 | 4/1988 | Fed. Rep. of Germany . |
| 62-34587 | 2/1987 | Japan . |

*Primary Examiner*—Frank T. Yost
*Assistant Examiner*—Rinaldi Rada
*Attorney, Agent, or Firm*—Fish & Richardson

[57] ABSTRACT

The invention is directed to an electric shaving apparatus having a shaving head pivotable about a pivot axis Z and a control means for the shaving head by means of which the extent of pivot movement of the shaving head is limited within a predetermined pivot area and also by means of which the shaving head is pivotable from any pivot position to a locked position.

29 Claims, 5 Drawing Sheets

ELECTRIC SHAVING APPARATUS WITH A SHAVING HEAD CONTROL MEANS

This invention relates to an electric shaving apparatus with a housing and a shaving head freely pivotable relative to the housing about a pivot axis to any pivot position relative to the housing, with at least one upper cutter and at least one lower cutter driven by a motor and in cooperative relation with the upper cutter, as well as at least one actuating switch provided on the housing.

BACKGROUND OF THE INVENTION

Shaving heads of this type (DE-A No. 36 10 736 and DE-A No. 37 21 243) have the advantage that, with the shaver housing held against the skin surface at typical angles, the entire shaving area usable for a shave engages the skin surface, and further that the shaving area or part of the usable shaving area does not become disengaged from the skin surface as the directions of sliding movement of the shaving head over the skin surface change.

It is an object of the present invention to provide in a device of the type initially referred to a control means for the freely pivoted shaving head permitting special shaving demands to be satisfied.

SUMMARY OF THE INVENTION

This object of the invention is accomplished in a shaving apparatus of the type initially referred to in that the actuating switch is operatively associated with at least one control member which, on actuation of the actuating switch, is engageable with at least one follower control member provided on the shaving head, independently of its pivot position, for the purpose of anchoring the same, and that the control means comprised of control member and follower control member permits a positive movement of the shaving head to, and/or its locking engagement in, at least one predetermined detent location.

It is an advantage of the control means of the invention that it enables a long-hair trimmer L provided on the shaving apparatus to be moved into optimum cutting positions both when used as part of the shaving head and as part of the actuating switch, in which positions it is possible to perform a combination shave with the short-hair cutter K provided in the shaving head or to trim longer hair using a long-hair trimmer L which protrudes over the short-hair cutter K. In the use of an actuating switch equipped with a long-hair trimmer, the control means effects a movement of the pivoted shaving head from any pivot position to a locked position which ensures that the actuating switch incorporating the long-hair trimmer can be moved into the pivot area cleared by the shaving head for the purpose of performing the combination shave with the short-hair cutter assembly K or the assemblies $K_1$ and $K_2$ provided in the shaving head and, additionally, for the purpose of long-hair trimming, with the position being visible from a mirror point of view.

By contrast, in the shaving apparatus according to JP-A No. 62-34587 a rotary shaving head with a short-hair cutter is provided which is not freely movable during the normal shave using the short-hair cutter but locked in place. The shaving head is turned by the long-hair trimmer by means of a positive motion control mechanism to a position excluding simultaneous use of long-hair trimmer and short-hair cutter. In one embodiment, the control elements of the positive motion control mechanism provided on the long-hair trimmer as well as on the shaving head are in permanent relative engagement, whereby freedom of movement of the rotary shaving head, that is, a swivelling movement of the shaving head about its axis of rotation, which movement is not subject to the positive motion control mechanism, is definitively excluded. In another embodiment, a coupling of the control elements providing for rotary motion of the shaving head as well as swivelling of the long-hair trimmer is only possible with the shaving head in the position intended for the short-hair shave, in which position the shaving head is locked in place.

In an embodiment of the invention, the control means is comprised of at least one control cam which is provided in the shaving head between two abutment stops limiting the pivot movement of the shaving head about the pivot axis and which includes at least one detent location, and of at least one displaceable tappet engaging the pivot area limited by the abutment stops, by means of which tappet the shaving head is automatically movable from any pivot position via the control cam into a predetermined detent location and lockingly engageable therewith by operation of the actuating switch acting on the tappet directly or indirectly.

An embodiment of the invention is characterized in that the housing of the shaving head includes at least one pivot area limiting the pivot movement, which area is engaged by a tappet acted upon by a spring, that at least one cam path with at least one detent location for the tappet is provided in the pivot area , that the tappet operable by the actuating switch via a pivoted lever is displaceable into the detent location via the cam path, and that the tappet is maintained locked in the detent location by the lever and the actuating switch.

A further embodiment of the invention is characterized in that the housing of the shaving head includes at least one pivot area limiting the pivot movement, which area is engaged by a tappet, that at least one cam path with at least one detent location for the tappet is provided in the pivot area, that the tappet is displaceable into the detent location by the actuating switch via the cam path and maintained locked in the detent location by the actuating switch.

A substantial advantage of these embodiments is that few components are needed to accomplish freedom of movement of the pivoted shaving head within a predetermined pivot area as well as to effect automatically a pivot movement of the shaving head from any pivot position into a locked position, enabling the user of such a shaving apparatus to make optimum use of the shaving assemblies provided, either in combination or singly, as required.

In an embodiment of the invention, a long-hair trimmer is provided at the end of the actuating switch close to the shaving head. In another embodiment of the invention, a long-hair trimmer is provided in the shaving head. In still another embodiment of the invention, the actuating switch may be formed of a single piece or it may be constructed as a dual switch.

In an embodiment of the invention, the shaving apparatus may be equipped with two actuating switches on the housing, such that one actuating switch is provided for actuation of the shaving head and that another actuating switch is provided for activating the electric drive. In such an embodiment, a tappet acting as control member is preferably formed on the actuating switch.

In a control member operatively associated with the actuating switch as a separate component, it will be an advantage to hold the tappet in abutment with the actuating switch by means of a spring.

The actuating switch preferably includes a driving surface for the lever. In a particularly advantageous embodiment of the invention, the actuating switch includes a driving surface and a bearing surface for the lever.

In accordance with the invention, a pivot area with abutment stops limiting the pivot movement of the shaving head is molded in at least one of two side walls of the shaving head housing. The follower control member is preferably provided by forming the wall of the molded-in pivot area, which wall interconnects the abutment stops, as a cam path. In a preferred embodiment, the detent location is provided in the area where the cam path blends into the abutment stop.

In accordance with a further embodiment, the follower control member may also be formed by providing between the abutment stops of the molded-in pivot area two cam paths terminating in a detent location. In a further modification of this embodiment, the detent location is part of a control groove which is adapted to slidably receive the tappet by means of a control cam being displaced up to the detent location. The control member is preferably a tappet which is linearly displaceable on the side wall of the housing and extends through an opening provided in the upper side wall. The tappet is preferably stepped.

In an embodiment of the invention, the freedom of movement of the pivoted shaving head may be limited by having the tappet extend into the molded-in pivot area, thus serving as a limit stop for the abutment stops.

Returning the tappet to its initial position or to a position limiting the pivot movement of the shaving head is accomplished by having the spring rest against a wall of the housing with one end while its other end bears against the tappet.

An embodiment of the invention provides a lever which is pivoted to the side wall of the housing and rests in its initial position against a stop provided on the side wall with one side and against the tappet with the other side. In a further modification of this embodiment, the lever is pivoted to the side wall of the housing and rests in its initial position against the tappet with one side and against the driving surface of the actuating switch with the other side.

Preferably, the end of the lever remote from the pivot bearing is chamfered. In a preferred embodiment of the invention, the tappet against which the spring bears is held locked in the detent location by means of abutment of the end surface of the lever with the bearing surface of the actuating switch. The switch positions of the actuating switch are preferably determined by interengageable locking means provided on the housing as well as on the actuating switch.

In an embodiment of the invention, a switch coulisse including at least two notches is provided on the actuating switch as a locking means. For engagement into the notches of the switch coulisse, a resilient arm including a locking cam is preferably provided on the housing as a locking means.

Further advantages and details of the invention will become apparent from the subsequent description in conjunction with the drawings illustrating some preferred embodiments.

DESCRIPTION OF PARTICULAR EMBODIMENTS

Figure 1:
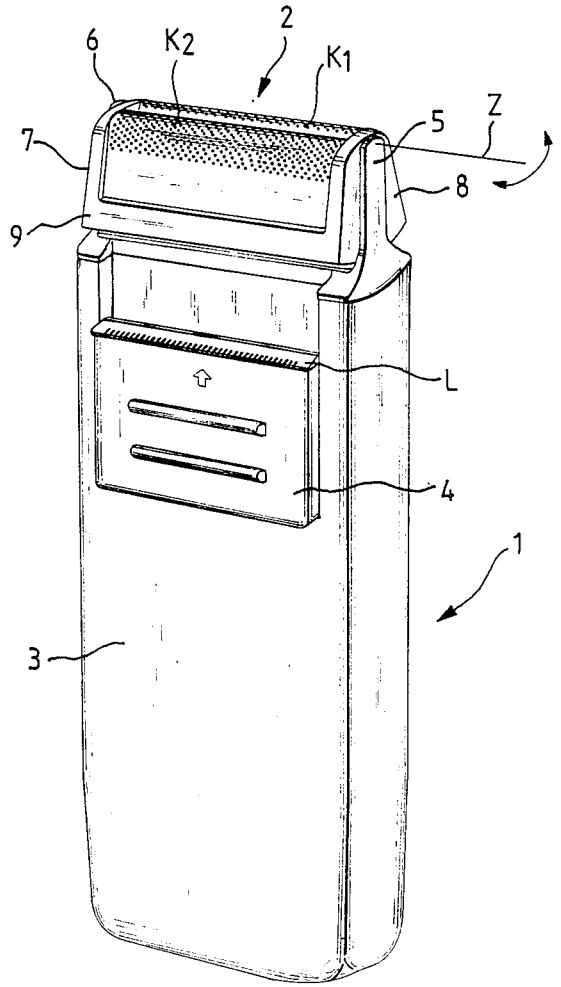
FIG. 1 is a perspective view of a shaving apparatus including a pivoted shaving head as well as an actuating switch equipped with a long-hair trimmer.

FIG. 1 shows an electric shaving apparatus including a housing 1 and a shaving head 2 pivotable relative to the housing about a pivot axis Z from the mid-position shown into opposite directions, with two short-hair cutter assemblies $K_1$, $K_2$ as well as an actuating switch 4 slidably arranged on the front panel 3 of the housing 1 and incorporating a built-in long-hair trimmer L. The shaving head 2 is freely pivotable between two supporting arms 5, 6 formed on the housing 1 by means of bearing elements not shown in the drawing.

Figure 2:
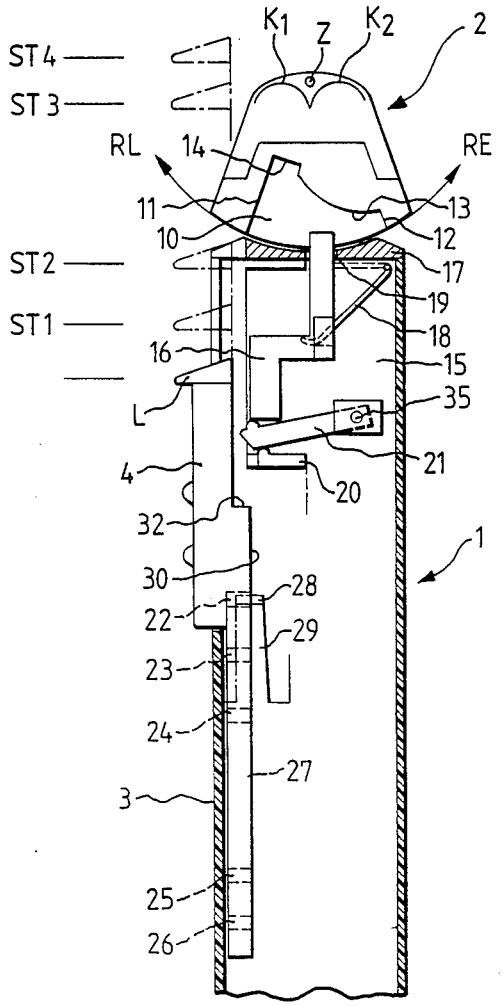
FIG. 2 is a longitudinal sectional view of the shaving apparatus of FIG. 1.

FIG. 2 shows a section made through the shaving apparatus of FIG. 1, illustrating the control means for this particular embodiment. Molded in the side wall 7 of the shaving head housing 9 is a pivot area 10 the circumferential side wall of which is formed such as to provide abutment stops 11, 12, a cam path 13 as a followercontrol member, as well as a detent location 14. Acting as control member is a stepped tappet 16 mounted on the side wall 15 in the housing 1 so it is linearly displaceable in opposition to the pressure of a spring 18 bearing against the tappet 16 with one end and against the upper side wall 17 of the housing with the other end.

The tappet 16 extends through an opening 19 provided in the upper side wall 17, with the opening 19 in the upper side wall 17 being positioned such that the tappet 16 extends centrically into the pivot area 10 of the shaving head 2 when in mid-position. Under the action of the pressure of the spring 18, a stop 20 provided on the side wall 15 keeps both the abutting lever 21, which is pivotally mounted on the side wall 15, and the tappet 16 which rests on the lever 21 in the initial position shown. The tappet 16 which in its initial position projects a small amount into the pivot area 10 through the opening 19 serves as limit stop for the pivot movement of the shaving head 2 about the pivot axis Z, with the extent of the pivot movement being predetermined by the relative distance of the abutment stops 11 and 12 in the pivot area 10.

Slidably mounted on the front panel 3 of the housing 1 is the actuating switch 4 with an integrated long-hair trimmer L. Formed on the actuating switch 3 is a switch coulisse 27 with five notches 22, 23, 24, 25, 26 which, in combination with a locking cam 28 of a resilient arm 29 formed on the side wall 15 of the housing 1, determine the respective switch position of the actuating switch 4. The actuating switch 4 is stepped on the side close to the tappet. The stepped wall extending parallel to the sliding direction of the actuating switch 4 serves as bearing surface 30 for the chamfered end 31 of the pivoted lever 21, and the stepped wall extending transversely to the bearing surface 30 serves as driving surface 32 for the lever 21 abutting it at times.

In the OFF position of the actuating switch 4 in which the locking cam 28 of the resilient arm 29 engages into the notch 22 of the switch coulisse 27, the driving surface 32 is at a predetermined distance to the lever 21 which rests on the stop 20. Sliding the actuating switch 4 into the first switch position ST 1 in which the locking cam 28 is in engagement with the notch 23 causes the driving surface 32 to abut the lever 21. This first switching operation activates the electric drive, not shown, of the shaving apparatus and thus the cutter assembly or assemblies provided in the shaving head 2, with the tappet 16 entering the pivot area 10 then enabling the operative shaving head 2 to execute pivot movements about the pivot axis Z, these movements being limited by the pivot area.

In the second switch position ST 2 of the actuating switch 4, the locking cam 28 is in engagement with the notch 24, with the long-hair cutter L integrated into the actuating switch assuming a position relative to the shaving head 2 which is approximately on a level with the upper side wall 17, that is, below the pivot arc 33 of the bottom surface 34 of the pivoted shaving head 2. This position, the preceding as well as the subsequent positions assumed by the long-hair trimmer L as a result of the displacement of the actuating switch 4 are shown in broken lines in FIG. 2. As the actuating switch 4 is moved from the first switch position ST 1 to the second switch position ST 2, the lever 21 is initially picked up by the driving surface 32. In the process, the tappet 16 resting on the lever 21 is brought into engagement with the cam path 13 in opposition to the pressure of the spring 18, whereby the cam control action provided in this embodiment is tripped due to the sliding pressure exerted on the actuating switch 4, causing the tappet 16 to move along the cam path 13 into the detent location 14 provided. In the embodiment of FIG. 2, the detent location 14 is provided in the shaving head 2 on the side close to the sliding path of the actuating switch 4. In the course of this switching operation, the shaving head 2 illustrated in a mid-position pivots in the direction RE under the action of the tappet 16 on the cam path 13 and, following locking engagement of the tappet 16 in the detent location 14, is maintained in the swung-out position by the tappet by means of the actuating switch 4 the notch 24 of which is engaged by the locking cam 28.

Figure 6:
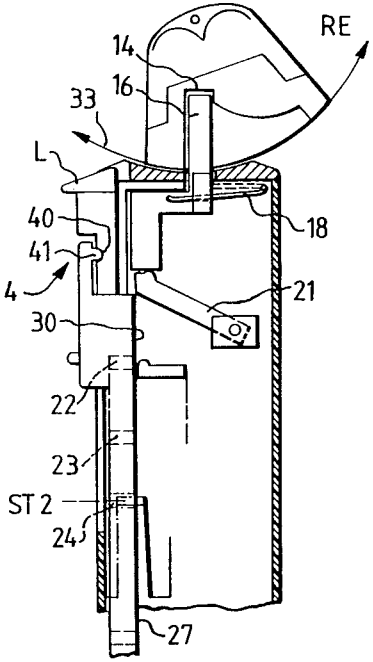
Figure 5:
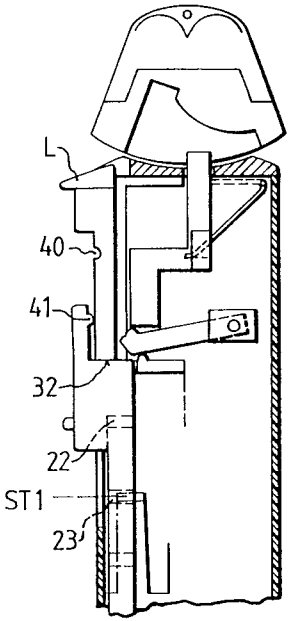
Figure 4:
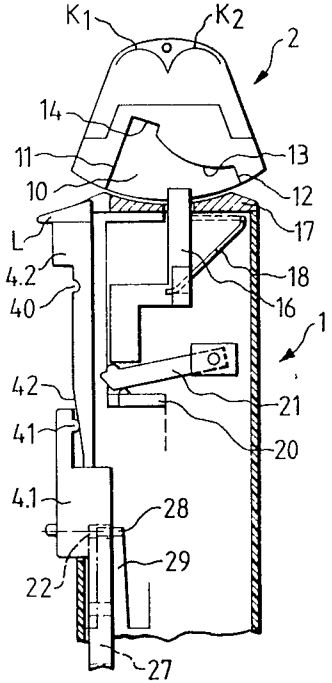

As becomes apparent from FIG. 6, for example, the shaving head 2 swung out in the direction RE and held in locked position clears the sliding path of the actuating switch 4 with its integrated long-hair trimmer L for further switch positions in order to permit, for example, a combination shave involving the long-hair trimmer L and the short-hair cutter K provided in the shaving head 2, in addition to permitting the trimming of longer hair using a clearly visible long-hair trimmer L adapted to be positioned above the short-hair cutter K.

The length of the lever 21 from the pivot bearing 35 to the end 31 is dimensioned such that, with an actuating switch 4 in the second switch position ST 2, the pivot movement released by the driving surface 32 has caused the lever 21 to move from the driving surface 32 into engagement with the bearing surface 30, whereby the tappet 16 is held in engagement with the detent location by the lever 21 while the sliding path for displacement of the actuating switch 4 into the third and the subsequent fourth switch position ST 3 and ST 4 is cleared.

In consequence, with the shaving head 2 maintained locked in a pivoted position, the actuating switch 4 incorporating the long-hair trimmer L is free to be moved into the third switch position ST 3 which is provided for a combination shave involving the long-hair trimmer L and the short-hair cutter K, a well as into the fourth switch position ST 4 provided for long-hair trimming, with the long-hair trimmer L being coupled to the drive assembly, not shown, of the shaving apparatus in the third and fourth switch positions.

As the actuating switch 4 is returned from the switch position ST 2 to the switch position ST 1, the tappet 16 disengages from the detent location 14 under the action of the pressure of the spring 18, moving the pivoted lever 21 into abutment with the stop 20 and thus returning to its initial position. The shaving head 2 which is then unlocked is again free to pivot about the pivot axis Z, its movement being limited by the abutment stops 11 and 12 and the tappet 16 which in the initial position projects a small amount into the pivot area 10.

With the actuating switch 4 returned to the OFF position, the electric drive of the shaving apparatus is deactivated.

Figure 3:
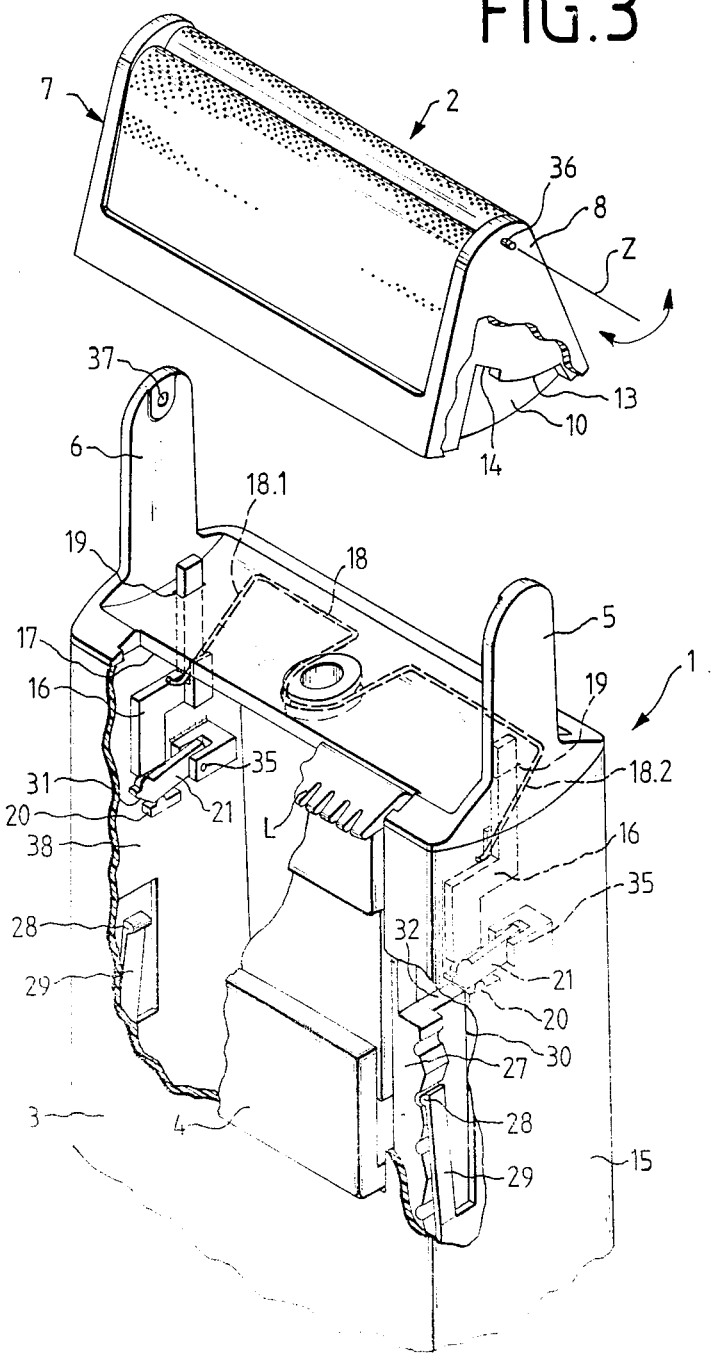
FIG. 3 is an exploded view in perspective of the shaving head as well as of the upper part of a shaver housing with the housing walls partly broken away.
Figure 7:
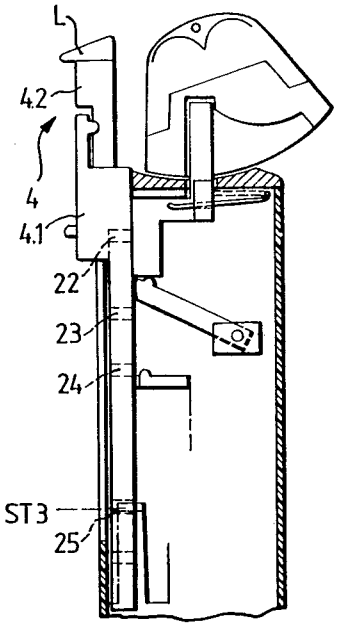
FIGS. 4 to 7 are longitudinal sectional views of the shaving apparatus of FIG. 3 showing the actuating switch in different switch positions.

FIG. 3 shows an exploded view of the shaving head 2 and the upper part of the housing 1 of a shaving apparatus, with the side walls of the housing 1 partly broken away, as well as an actuating switch 4 arranged on the front panel 3 and configured as a dual switch comprised of an actuating member 4.1 and an actuating member 4.2 which is equipped with a long-hair trimmer L. Provided on the side walls 7 and 8 of the shaving head 2 are bearing pins 36 by means of which the shaving head 2 is pivoted about the pivot axis Z in bearing bores 37 provided in the supporting arms 5 and 6. Molded in the side walls 7 and 8 of the shaving head 2 are pivot areas 10 of identical construction. A cutout provided for reasons of better representation makes it possible to see the pivot area molded in the side wall 8.

For the purpose of accomplishing a balanced controlled movement of the shaving head 2 to the detent locations 14 provided in the pivot areas 10, the components of the control means shown and described with reference to FIG. 2 are situated in relative symmetrical arrangement on the side walls 15 and 38 of the housing 1 as well as on the actuating switch 4, that is, on its actuating member 4.1. The spring 18 bearing against the upper side wall 17 is integrally formed, holding with its spring arms 18.1 and 18.2 the tappets 16 as well as the levers 21 in an initial position which is determined by abutment of the levers 21 pivoted in the pivot bearings 35 with the stops 20. In the upper side wall 17, two openings 19 are provided through which the tappets 16 extend a small amount in the initial position shown. The opening 39 in the upper side wall 17 serves to receive a drive pin, not shown, of the electric drive for operating the cutter assemblies provided in the shaving head 2. In each of the side walls 15 and 38 of the housing 1, a resilient arm 29 is provided the locking cam 28 of which is engageable with the notches 22, 23, 24 and 25 molded in the switch coulisses 27, thereby determining the individual switch positions of the actuating member 4.1 of the actuating switch 4. The two switch coulisses 27 of which only one is shown in FIGS. 3 to 7 form a constituent part of the actuating member 4.1. Actuating member 4.1 provides in the area of the ends 31 of the levers 21 driving surfaces 32 and bearing surfaces 30 for the levers 21 moving the tappets 16 to the detent locations 14 and maintaining them in these positions. For reasons of clarity, only one driving surface 32 and one bearing surface 30 are shown in the drawings.

The sequence of switching operations of the actuating switch 4 of FIG. 3 which is configured as a dual switch is shown in greater detail in FIGS. 4 to 7. In the OFF position shown in FIG. 4, the locking cam 28 is in engagement with the notch 22 of the switch coulisse 27 formed on the actuating member 4.1 The actuating member 4.2 provided above the actuating member 4.1 and equipped with a long-hair trimmer L extends up to the level of the upper side wall 17. The front of the actuating member 4.2 includes a recess 40 which is engaged by the locking cam provided on the actuating member 4.1 when in the switch position ST 2 shown in FIG. 6, in order to move the actuating member 4.2 to the switch position ST 3 of FIG. 7 and back to switch position ST 2 which is the initial position for the actuating member 4.2. In the OFF position of the switch, the driving surface 32 provided on the actuating member 4.1 is at a predetermined distance to the lever 21 resting on the stop 20. By displacing the actuating member 4.1 to the switch position ST 1 of FIG. 5, the electric drive, not shown, of the shaving apparatus is activated and the driving surface 32 is brought into abutment with the pivoted lever 21. In the process, the locking cam slides along the slightly beveled front 42 of the actuating member 4.2, without picking it up. In the switch position ST 1 of FIG. 5, the operating shaving head 2 is allowed to perform a pivot movement about the pivot axis Z, this movement being limited by the tappet 16 engaging in the pivot area 10 as well as by the abutment stops 11 and 12 provided in this area.

As the actuating member 4.1 is displaced to the switch position ST 2 of FIG. 6, the lever 21 is picked up by the driving surface 32, thereby urging at the same time the tappet 16 against the cam path 13 in opposition to the pressure of the spring 18 and causing the shaving head 2 to pivot and become locked in place following engagement of the tappet 16 in the detent location 14, thus clearing the way for displacement of the actuating switch 4 equipped with a long-hair trimmer L. As the switch position ST 2 is reached, the locking cam 41 slides into the recess 40, thus mechanically coupling the actuating members 4.1 and 4.2, so that the actuating member 4.2 equipped with a long-hair trimmer L can then be moved by the actuating member 4.1 to the further switch position ST 3 of FIG. 7 and back again. As a result of the pivot movement executed by the lever 21 when a change from switch position ST 1 to switch position ST 2 occurs, the actuating member 4.1 is allowed to move with its bearing surface 30 along the end surface 31 of the lever 21 to the switch position ST 3 of FIG. 7, with the locked condition of the shaving head 2 being maintained by abutment of the end surface 31 of the lever 21 with the bearing surface 30 of the actuating member 4.1. In dependence on the distance of the notches 24 and 25 provided in the switch coulisse 27, the long-hair trimmer L provided in the actuating member 4.2 is extended from its position corresponding to the level of the upper side wall 17 to a position in which either a combination shave with the short-hair cutter provided in the shaving head 2 or only long-hair trimming can be performed. As already illustrated and described with reference to FIG. 2, a further notch 26 may be provided in the switch coulisse 27 permitting a combination shave in the switch position ST 3 and the trimming of long hair in the additional switch position ST 4 which is determined by the notch 26 not shown.

Figure 8:
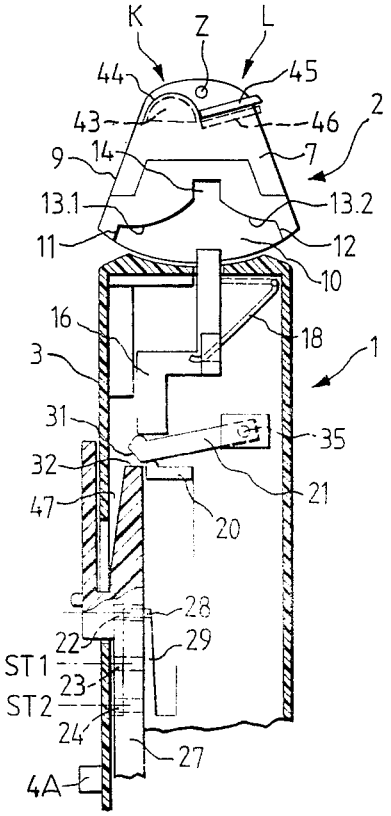
FIG. 8 is a longitudinal sectional view of a shaving apparatus including an actuating switch as well as a shaving head incorporating different shaving assemblies.

FIG. 8 shows a longitudinal section through a shaving apparatus with an actuating switch 4 made in one piece. To energize and deenergize the electric drive, this embodiment provides a second actuating switch 4*a*. To control the shaving head 2 pivotally mounted about the pivot axis Z, a switch coulisse 27 including several notches 22, 23, 24 is formed on the actuating switch 4. The shaving head 2 accommodates two different hair cutter assemblies including a short-hair cutter assembly K comprised of an arcuate lower cutter 43 and an upper cutter 44 in cooperative relation therewith as well as a long-hair trimmer L comprised of a shaving comb 45 and a cutter blade 46. Molded in the side wall 7 of the shaving head housing 9 is a pivot area 10 whose circumferential side wall is formed such as to provide abutment stops 11 and 12 as well as two cam paths 13.1 and 13.2 terminating in the center of the relative distance of the abutment stops 11 and 12 in a detent location 14 in order to locate the shaving head 2 in the mid-position shown by means of the tappet 16.

With the actuating switch 4 in the OFF position as shown, the locking cam 28 of the resilient arm 29 provided on the housing 1 is in engagement with the notch 22. The actuating switch 4 is provided with a recess 47 to permit displacement of the actuating switch 4 on an externally closed front panel 3 of the housing 1. In this embodiment, in the OFF position of the actuating switch the lever 21 pivotally carried in the pivot bearing 35 rests on the driving surface 32 in addition to being in abutment with the stop 20. By moving the actuating switch 4 to the switch position ST 1, the driving surface 32 causes the lever 21 to pivot about the pivot bearing 35 in the direction of the shaving head 2. In the process, the lever 21 moves the tappet 16 against the pressure of the spring 18 into abutment with one of the cam paths 13.1 or 13.2, depending on the prevailing pivot position of the shaving head 2. The sliding pressure acting via the actuating switch 4, the lever 21 and the tappet 16 on the respective cam path 13.1 or 13.2 causes the shaving head 2 to pivot about the pivot axis Z until the tappet 16 lockingly engages the detent location 14. At the same time, the locking cam 28 slides into engagement with the notch 23, whereby the actuating switch 4 which is in the switch position ST 1 maintains the shaving head 2 in the locked position. With the shaving head 2 thus locked in place, the individual hair cutter assemblies provided may be used either singly or in combination to cut the hair.

In the embodiment of FIG. 8, the driving surface 32 may also serve the function of a bearing surface 30, depending on the length of the lever 21 from the pivot bearing 35 to the end surface 31.

Figure 9:
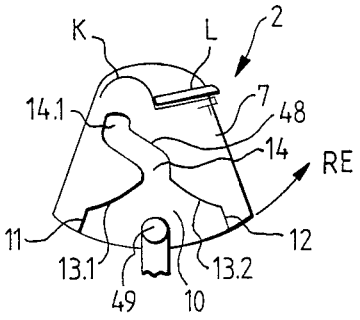
FIG. 9 is a view of the curve shape of a pivot area molded in a side wall of the shaving head.

The embodiment of FIG. 8 permits, however, also a different form of the pivot area 10 as, for example, in FIG. 9, on condition that the actuating switch 4 has at least a second switch position ST 2 in the switch coulisse 27 for this purpose, as shown, and on condition that the length of the lever 21 is adjusted relative to the driving surface 32 and the bearing surface 30 of the actuating switch 4 in a manner ensuring that the lever 21 slides from the driving surface 32 over to the bearing surface 30, as illustrated and described with reference to FIGS. 2 to 7. Accordingly, the pivot area 10 may be formed as shown in FIG. 9 in both the embodiment of FIG. 8 and the embodiments of FIGS. 2 to 7. Molded in the side wall 7 of the shaving head housing 9 of FIG. 9 is a pivot area 10 whose circumferential side wall is formed such that the molding provides two abutment stops 11 and 12, two cam paths 13.1 and 13.2 extending from the abutment stops and terminating in a detent location 14, as well as an approximately L-shaped control groove 48 terminating in the detent location 14 and having at its end another detent location 14.1, with the control groove 48 being aligned from the detent location 14 in the direction of the side of the shaving head housing on which the abutment stop 11 is provided. As in the embodiments of FIGS. 2 to 8, in the OFF position of the shaving apparatus the tappet 16 extends a small amount into the pivot area 10, thus serving as a limit stop for the predetermined pivot movement of the shaving head 2. The tappet 16 includes a control cam 49 which, following movement of the tappet 16 to the position locking the shaving head 2 in place, is in engagement with the detent location 14, thus arresting the shaving head 2 in the initial mid-position shown in FIG. 8. In the course of movement of the actuating switch 4 to switch position ST 2 which, according to FIG. 8, for example, ends with the locking cam 28 engaging the notch 23, the linearly displaceable control cam 49 slides in the control groove from detent location 14 to detent location 14.1, thereby causing the shaving head 2 to pivot in direction RE. After the control cam 49 has reached the detent location 14.1, the swung-out shaving head 2 is held in position by tappet 16, by lever 21 abutting the bearing surface 30 and by actuating switch 4 locked in switch position ST 2. In the use of a shaving head 2 equipped with different shaving assemblies, this locked position of the pivotally mounted shaving head 2 permits an excellent positioning of the long-hair trimmer L for trimming purposes, with the shaving head 2 locked in swung-out position being at the same time usable for a combination shave.

The components of the control means for the shaving head 2 pivotable about the pivot axis Z which are described with reference to FIGS. 1 to 10 may be provided on one of the side walls 15 or 38 of the shaver body shown or, alternatively, on both side walls 15 and 38 in relative symmetrical arrangement, with the last-mentioned embodiment being preferable because this arrangement allows a smooth and balanced controlled motion of the shaving head 2 to the detent locations provided.

Figure 10:
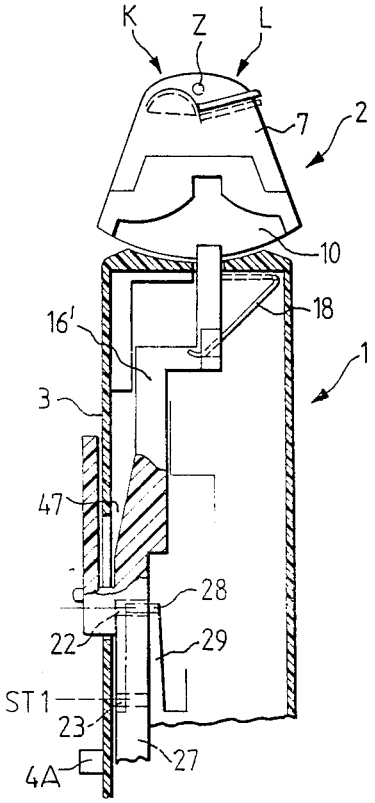
FIG. 10 is a longitudinal sectional view of a shaving apparatus including a tappet formed on the actuating switch.

FIG. 10 shows a further embodiment of the shaving apparatus described with reference to FIG. 8, including a tappet 16′ formed on the actuating switch 4 and a switch coulisse 27 also formed thereon in which notches 22, 23 are provided. With the actuating switch 4 in the OFF position as shown, the notch 22 is engaged by the locking cam 28 of the resilient arm 29 provided on the housing 1, with the tappet 16′ projecting a small amount into the pivot area 10 of the shaving head 2 for the purpose of limiting the pivot movement of the shaving head 2 about the pivot axis Z. As the actuating switch 4 is moved to switch position ST 1, the tappet 16′ will abut one of the cam paths 13.1 or 13.2, causing by means of the sliding pressure acting on these paths a pivot movement of the shaving head 2 until the tappet 16′ is in locking engagement with the detent location 14. The tappet 16′ and thus the shaving head 2 are held in the locked position by the actuating switch 4 in switch position ST 1. The spring provided in this embodiment which bears with one end against the upper side wall 17 and with its other end against the tappet 16′ is no necessary requirement. It merely serves the purpose of facilitating the return of the tappet 16′ and the actuating switch 4 from the switch position ST 1 to the OFF position. In a further embodiment, it is however possible to construct the tappet 16′ and the actuating switch 4 as separate components. In such an embodiment, the provision of the spring 18 is necessary in order to return the tappet 16′ abutting the actuating switch 4 together with the actuating switch 4 from the switch position ST 1 to the OFF position.

It is to be understood that any of the embodiments described in the foregoing may be provided with a further switch position by means of which the tappet 16 is movable to an initial position in which the function as limit stop for the abutment stops 11 and 12 and thus for the shaving head 2 is eliminated and put to effect not until after the actuating switch 4 has executed a first switching operation.

We claim:

1. An electric shaving apparatus comprising a housing, a shaving head having two side walls, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure molded in at least one of said two side walls of said shaving head, and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location, said follower structure including two abutment stops for limiting the pivot movement of said shaving head about said pivot axis (Z), at least one control cam provided between said two abutment stops, and at least one detent location, and said control structure including at least one displaceable tappet portion for engaging said follower structure, said shaving head being automatically movable by said tappet portion from any pivot position via said control cam into a predetermined detent location and locked in said detent location by operation of said actuating switch acting on said tappet portion directly or indirectly.

2. A shaving apparatus as claimed in claim 1 wherein said molded-in follower structure includes a wall that interconnects said abutment stops and is formed as a cam path.

3. A shaving apparatus as claimed in claim 2, wherein said detent location is provided in the area where said cam path blends into an abutment stop.

4. A shaving apparatus as claimed in claim 1 wherein said molded-in follower structure includes two cam paths that terminate in a detent location and said cam paths are provided between said abutment stops.

5. A shaving apparatus as claimed in claim 4 wherein said detent location is part of a control groove which is adapted to slidably receive a tappet portion of said control structure.

6. An electric shaving apparatus comprising a housing, a shaving head, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure on said shaving head, said follower structure of said shaving head including at least one pivot area limiting said pivot movement and at least one cam path with at least one detent location and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location, said control structure including a tappet acted upon by a spring and operable by said actuating switch via pivoted lever for displacement into said detent location via said cam path, and said tappet being maintained locked in said detent location by said lever and said actuating switch.

7. A shaving apparatus as claimed in claim 6 wherein said tappet against which said spring bears is held locked in said detent location by means of abutment of an end surface said lever with said actuating switch.

8. An electric shaving apparatus comprising a housing, a shaving head, structure supporting said shaving head on said housing for free pivotal movement about a pivot axis (Z), said shaving head having at least one upper cutter and at least one lower cutter driven by an electric drive and in cooperative relation with said upper cutter, a first actuating switch for pivoting and latching said shaving head, a second actuating switch on said housing for activating said electric drive, follower structure on said shaving head, and control structure movable in response to said first actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location.

9. A shaving apparatus as claimed in claim 8 wherein said control structure includes a tappet on said first actuating switch.

10. A shaving apparatus as claimed in claim 8 wherein said control structure includes a tappet, and further including a spring for holding said tappet in abutment with said first actuating switch.

11. An electric shaving apparatus comprising a housing, a shaving head, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure on said shaving head, and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location, said follower structure being comprised of at least one control cam which is provided in said shaving head between two abutment stops limiting the pivot movement of said shaving head about said pivot axis (Z) and which includes at least one detent location, and said control structure including at least one displaceable tappet for engaging said follower structure, said shaving head being automatically movable by said tappet from any pivot position via said control cam into a predetermined detent location and lockingly engageable therewith by operation of said actuating switch acting on said tappet directly or indirectly.

12. A shaving apparatus as claimed in claim 11 wherein said tappet is linearly displaceable on the side wall of said housing and extends through an opening provided in the upper wall of said housing.

13. A shaving apparatus as claimed in claim 12 wherein said tappet is stepped.

14. A shaving apparatus as claimed in claim 12 wherein said tappet is adapted to extend into said follower structure, thus serving as a limit stop for said abutment stops.

15. A shaving apparatus as claimed in claim 11 and further including a spring that has two ends, one of said ends resting against a wall of said housing and its other end resting against said tappet.

16. An electric shaving apparatus comprising a housing, a shaving head, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure on said shaving head, and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location.

17. An electric shaving apparatus as claimed in claim 16 wherein said control structure includes a tappet, and said follower structure includes at least one pivot area limiting the pivot movement, said pivot area being engageable by said tappet and including at least one cam path and at least one detent location for said tappet, said tappet being displaceable into said detent location by said actuating switch via said cam path and maintained locked in said detent location by sid actuating switch.

18. A shaving apparatus as claimed in claim 16 wherein said control structure includes a lever and said actuating switch includes a driving surface for said lever.

19. A shaving apparatus as claimed in claim 18 wherein said actuating switch further includes a bearing surface for said lever.

20. A shaving apparatus as claimed in claim 16 and further including interengageable locking structure on said housing and on said actuating switch for determining switch positions of said actuating switch.

21. A shaving apparatus as claimed in claim 20 wherein said actuating switch includes a switch coulisse with at least two notches as a locking means.

22. A shaving apparatus as claimed in claim 20 and further including resilient arm structure including a locking cam on said housing as a locking means.

23. A shaving apparatus as claimed in either of the claims 16 or 11 and further including a long-hair trimmer (L) provided at the end of said actuating switch close to said shaving head.

24. A shaving apparatus as claimed in either of the claims 16 or 11 and further including a long-hair trimmer (L) provided in said shaving head.

25. A shaving apparatus as claimed in either of the claims 16 or 11 wherein said actuating switch is formed of a single piece.

26. A shaving apparatus as claimed in either of the claims 16 or 11 wherein said actuating switch is a dual switch.

27. An electric shaving apparatus comprising a housing, a shaving head, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure on said shaving head, said follower structure including at least one pivot area limiting said pivot movement, at least one cam path and at least one detent location, and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location, said control structure including a tappet acted upon by a spring and operable by said actuating switch via a pivoted lever for displacement into said detent location via said cam path, and said tappet being maintained locked in said detent location by said lever and said actuating switch, said lever being pivoted to a side wall of said housing and having one side resting in its initial position against a stop provided on said side wall and another side resting against said tappet.

28. An electric shaving apparatus comprising a housing, a shaving head, structure supporting said shaving head on said housing for free pivotal movement about a pivot axis (Z), said shaving head having at least one upper cutter and at least one lower cutter driven by a motor and in cooperative relation with said upper cutter, at least one actuating switch on said housing, follower structure on said shaving head, said follower structure including at least one pivot area limiting said pivot movement, at least one cam path and at least one detent location, and control structure movable in response to said actuating switch between a first position spaced from said follower structure in which said shaving head is freely pivotable about said pivot axis and a second position in engagement with said follower structure for positively rotating said shaving head about said pivot axis to a predetermined detent location, and anchoring said shaving head in said predetermined detent location, said control structure including a tappet acted upon by a spring and operable by said actuating switch via a pivoted lever for displacement into said detent location via said cam path, and said tappet being maintained locked in said detent location by said lever and said actuating switch, said lever being pivoted to a side wall of said housing and having one side resting in its initial position against said tappet and another side resting against a driving surface of said actuating switch.

29. A shaving apparatus as claimed in any one of the claims 27 or 28 wherein the end of said lever remote from the pivot bearing is chamfered.

* * * * *